US009206494B2

(12) United States Patent
Kernig et al.

(10) Patent No.: US 9,206,494 B2
(45) Date of Patent: Dec. 8, 2015

(54) ALUMINUM STRIP USED FOR LITHOGRAPHIC PRINTING PLATE SUPPORTS

(75) Inventors: Bernhard Kernig, Köln (DE); Henk-Jan Brinkman, Bonn (DE)

(73) Assignee: Hydro Aluminium Deutschland GmbH, Grevenbroich (DE)

( * ) Notice: Subject to any disclaimer, the term of this patent is extended or adjusted under 35 U.S.C. 154(b) by 1347 days.

(21) Appl. No.: 12/374,022

(22) PCT Filed: Jul. 20, 2007

(86) PCT No.: PCT/EP2007/057532
§ 371 (c)(1),
(2), (4) Date: Jun. 30, 2009

(87) PCT Pub. No.: WO2008/009747
PCT Pub. Date: Jan. 24, 2008

(65) Prior Publication Data

US 2009/0324994 A1 Dec. 31, 2009

(30) Foreign Application Priority Data

Jul. 21, 2006 (EP) ..... 06117701

(51) Int. Cl.
*C22C 21/00* (2006.01)
*B41N 1/08* (2006.01)

(52) U.S. Cl.
CPC ..... *C22C 21/00* (2013.01); *B41N 1/083* (2013.01); *Y10T 428/12993* (2015.01)

(58) Field of Classification Search
USPC ..... 420/547
IPC ..... C22C 21/00; B41N 1/083
See application file for complete search history.

(56) References Cited

U.S. PATENT DOCUMENTS

| | | | | |
|---|---|---|---|---|
| 4,822,715 | A | 4/1989 | Shoji et al. | |
| 6,337,136 | B1 | 1/2002 | Suzuki et al. | |
| 2001/0038908 | A1 | 11/2001 | Matsuki et al. | |
| 2005/0258136 | A1 | 11/2005 | Kawanishi et al. | |
| 2008/0035488 | A1 * | 2/2008 | Martin et al. | 205/153 |

FOREIGN PATENT DOCUMENTS

| | | |
|---|---|---|
| EP | 0978573 | 2/2000 |
| EP | 0 795 048 B1 | 3/2000 |

(Continued)

*Primary Examiner* — Roy King
*Assistant Examiner* — Janelle Morillo
(74) *Attorney, Agent, or Firm* — Reinhart Boerner Van Deuren P.C.

(57) ABSTRACT

A strip for the production of a substrate for lithographic printing plates consisting of aluminum or an aluminum alloy and has at least to some extent a microcrystalline surface layer as a result of hot and/or cold roll passes. When analyzed in a two-dimensional microprobe analysis according to the mapping method of a surface region of the microcrystalline surface of the strip, the surface portion having an intensity ratio $I/I_{bulk(avg)}$ of greater than 3 in the spectral range of the $K_{\alpha 1}$ line of the X-ray emission spectrum of oxygen of the measured microcrystalline surface layer is less than 10%, preferably less than 7%, wherein, during the two-dimensional microprobe analysis, an excitation voltage of 15kV, a beam current of 50 nA and a beam cross section of 1 μm is used with a step size of 16.75 μm for the electron beam.

4 Claims, 1 Drawing Sheet

(56) References Cited

FOREIGN PATENT DOCUMENTS

| | | | |
|---|---|---|---|
| EP | 1 136 280 | | 9/2001 |
| EP | 1 598 138 | A1 | 11/2005 |
| JP | 2004-035984 | A | 2/2004 |
| WO | WO 2007045676 | A1 * | 4/2007 |

* cited by examiner

ALUMINUM STRIP USED FOR LITHOGRAPHIC PRINTING PLATE SUPPORTS

CROSS-REFERENCE TO RELATED APPLICATIONS

This application is a National Phase Application of International Application No. PCT/EP2007/057532, filed on Jul. 20, 2007, which claims the benefit of and priority to European patent application no. EP 06 117 701.0, filed Jul. 21, 2006. The disclosures of the above applications are incorporated herein by reference in their entirety.

FIELD OF THE INVENTION

The invention relates to a strip for the production of a substrate for lithographic printing plates consisting of aluminum or an aluminum alloy, the strip having at least to some extent a microcrystalline surface layer as a result of hot and/or cold roll passes. Furthermore, the invention relates to a method for the characterization of a surface of a strip for the production of lithographic printing plate substrates.

BACKGROUND

Strips for the production of substrates for lithographic printing plates are produced by rolling after casting of an according aluminum alloy. The strip is usually produced by hot rolling a billet followed by cold rolling. After the strip has been produced, it is degreased and wound onto a coil. The coil is subjected to a pre-treatment by the manufacturer of the substrate for lithographic printing plates and then roughened by electrochemical means. Up until now, the microcrystalline surface layer, introduced by rolling, of the aluminum strip was removed to a great extent by the pre-treatment, such that the microcrystalline surface layer no longer played any part in respect of the subsequent electrochemical roughening procedure. With increasing production rates and thus a decreasing etching depth in the preceding cleaning steps and also during electrochemical roughening, based on the microcrystalline surface layer of the aluminum strips which, as of now, is becoming relevant, manufacturing defects appear more frequently due to poor roughening results.

SUMMARY OF THE INVENTION

In general, an aspect of the present invention is to provide a strip for the production of lithographic printing plate substrates, which strip has an improved microcrystalline surface layer such that higher production rates are made possible during the production of lithographic printing plate substrates. A further aspect of the invention is to propose a method for the characterization of the surface quality of the microcrystalline surface structure of strips consisting of aluminum or an aluminum alloy.

According to a first teaching of the present invention, the strip with improved microcrystalline surface layer is achieved in that in a two-dimensional microprobe analysis according to the mapping method of a surface region of the microcrystalline surface of the strip, the surface portion with an intensity ratio $I/I_{bulk(avg)}$ of greater than 3 in the spectral range of the $K_{\alpha 1}$ line of the X-ray emission spectrum of oxygen of the measured microcrystalline surface layer is less than 10%, preferably less than 7%, wherein during the two-dimensional microprobe analysis, an excitation voltage of 15 kV, a beam current of 50 nA and a beam cross section of 1 μm is used with a step size of 16.75 μm for the electron beam.

It has surprisingly been found that a strip for the production of a substrate for lithographic printing plates having a specific occurrence and size of oxide particles in the microcrystalline surface layer can be achieved with very good roughening characteristics in the subsequent production process for lithographic printing plate substrates and the production rates overall can be increased. The oxide particles which usually disrupt the electrochemical roughening procedure are present in such a small number and size in the microcrystalline surface layer of the strip according to the invention that the microcrystalline surface layer can be roughened very well and thus very good roughening results can be achieved during the production of printing plate substrates even when a small amount of material is removed in the electrochemical roughening procedure due to high production rates. In two-dimensional microprobe analysis, a surface portion of the strip is analysed by means of an electron beam having an excitation voltage of 15 kV, a beam current of 50 nA and a beam cross section of 1 μm with a step size of 16.75 μm. The electrons impinging on the surface of the strip produce X-ray Bremsstrahlung and characteristic X-ray emission spectra, whose wave lengths identify the element present in the sample and whose intensity provides information about the concentration or occurrence of the corresponding element in the measuring range of the electron beam cross section impinging on the surface to be measured. The highest intensities are exhibited by the $K_{\alpha 1}$ lines of the X-ray emission spectra. Due to the excitation voltage of 15 kV, the penetration depth of the electrons is limited to 1 to 2 μm, such that only layers of the strip which are near the surface are excited to emit the characteristic X-ray emission spectra. In particular, the penetration depth of the electrons coincides with the values, known from the literature, for the thickness of the microcrystalline surface layer which is produced from hot rolling the billet and, after cold rolling, typically amounts to 1 to 2 μm with final strip thicknesses of from 0.15 to 0.5 mm (in this respect see: Lindseth I., "Optical total reflectance, near surface microstructure, and topography of rolled aluminum materials", PhD thesis, NTNO, Trontheim, Norway, 1999). The $K_{\alpha 1}$ line of the X-ray emission spectrum of oxygen indicates the oxygen content of oxidic compounds in the microcrystalline surface layer at the corresponding measuring point. By the formation of the ratio from the measured microprobe signal of a microcrystalline surface layer and the averaged surface signal of a surface layer, stripped on the bulk material, of a strip, the substantially identical amounts of the relatively thin aluminum oxide film on the measured aluminum surfaces, which also contribute to the intensity of the characteristic oxygen spectrum, are averaged out, so that the ratio $I/I_{bulk(avg)}$ is substantially a measure for indication of the proportion of the oxygen atoms by rolled-in oxide particles in the region of the impinging electron beam of the microcrystalline surface layer of the strip. The intensity of the microprobe signal can thus be used as a measure for the size of the oxide particles. Due to the penetration depth of the electrons of approximately 1 to 2 μm, oxide particles rolled in under the surface by the rolling operation are in particular also detected which have been identified as being problematic with respect to the electrochemical roughening procedure. Thus, due to the restriction of the surface portions where $I/I_{bulk(avg)}>3$ to less than 10%, preferably less than 7%, the strip according to the invention for the production of lithographic printing plate substrates has a distribution of relatively small oxide particles, so that the strip according to the invention has very good roughening characteristics.

The thickness of the strip is preferably 0.15 to 0.5 mm and the thickness of the microcrystalline surface layer of the strip is preferably approximately 0.5 to 2.5 μm.

A further increase of the process velocities for the electrochemical roughening procedure of the strip for lithographic printing plate substrates can be ensured by the strip according to the invention in that during the two-dimensional microprobe analysis according to the mapping method of a surface portion of the strip, the surface portion with an intensity ratio $I/I_{bulk(avg)}$ of greater than 4 in the spectral range of the $K_{\alpha 1}$ line of the X-ray emission spectrum of oxygen of the measured microcrystalline surface layer is less than 3%, preferably less than 2%. In this case, the microcrystalline surface layer of the strip according to the invention has an even smaller number of larger oxide particles which can disrupt electrochemical roughening or the preceding pre-treatments.

The strip preferably consists of an aluminum alloy of type AA1050, AA1100 or AA3103. These aluminum alloys have already enjoyed widespread use regarding their suitability for the production of lithographic printing plate substrates.

A strip which is further improved in respect of strength and roughening ability for the production of lithographic printing plate substrates can be provided in that the aluminum strip consists of an aluminum alloy having the following proportions of alloy constituents in percent by weight:

| | |
|---|---|
| 0.05% ≤ | Si ≤ 0.1%, |
| 0.4% ≤ | Fe ≤ 1%, |
| | Cu ≤ 0.04%, |
| | Mn ≤ 0.3%, |
| 0.05% ≤ | Mg ≤ 0.3%, |
| | Ti ≤ 0.04%, |

remainder Al with unavoidable impurities
individually maximum 0.005%, in total maximum 0.15%.

According to a second teaching of the present invention, a method for the characterization of a surface of a strip, in particular a strip for the production of lithographic printing plate substrates, includes a two-dimensional microprobe analysis of the microcrystalline surface layer is carried out according to the mapping method and assessment of the quality of the surface of the strip using the measured intensity distribution in the spectral range of the $K_{\alpha 1}$ line of the X-ray emission spectrum of oxygen.

As already mentioned, the two-dimensional microprobe analysis affords the possibility of examining the microcrystalline surface layer to ascertain its composition and in particular the possibility of determining the distribution of oxide particles in the microcrystalline surface layer by the two-dimensional evaluation of the intensity distribution of the $K_{\alpha 1}$ line of the X-ray emission spectrum of oxygen. It is true that a two-dimensional microprobe analysis of surfaces by the mapping method is already known. However, a quality assessment of the surface of a strip of aluminum or an aluminum alloy using the intensity distribution in the spectral range of the $K_{\alpha 1}$ line of the X-ray emission spectrum of oxygen in respect of its suitability for the production of lithographic printing plate substrates has as yet not been carried out. As mentioned above, the suitability of the strip in particular in subsequent electrochemical roughening processes can be reliably checked by means of the characterization method according to the invention.

According to a first embodiment of the method according to the invention, the influence of the aluminum oxide film on the microcrystalline surface layer can be reduced in the measurement result in that the surface portion with a specific value for the intensity ratio $I/I_{bulk(avg)}$ is determined from the measured intensity distribution of the surface layer. In addition, an indication of the size of the oxide particles in the microcrystalline surface layer is provided by the intensity ratio $I/I_{bulk(avg)}$, and an indication of the occurrence of the oxide particles is provided by the surface portions having a specific value for the intensity ratio $I/I_{bulk(avg)}$. Thus, a combined measure for the size and the surface occupancy of the microcrystalline surface layer with oxide particles of a specific size is obtained from the mentioned intensity ratio. It has been found that in particular the combination of size and number of the oxide particles in the microcrystalline surface layer can have a negative effect on the subsequent electrochemical roughening process, if preceding etching steps do not completely remove the microcrystalline surface layer or a surface consisting of bulk material is roughened, respectively.

If an excitation voltage of from 5 to 20 kV, preferably 15 kV, a beam current of from 10 to 100 nA, preferably 50 nA and a beam cross section of from 0.2 to 1.5 μm, preferably 1 μm are used for the electron beam, it is not only possible to limit the penetration depth of the electrons, but also by means of the beam current and the beam cross section, to achieve excitation densities and X-ray emission intensities which reduce measurement errors in the determination of the surface portions.

A measurement duration per measuring point of from 0.3 to 1 s, preferably 0.6 s also does a part here. Moreover, the measurement time per measuring point ensures that a sufficiently large strip surface portion can be measured within an adequate time.

Finally, a linear-focusing spectrometer with a crystal having an interplanar spacing 2 d of 6 nm is preferably used, preferably a LDE1H crystal. The crystal in linear-focusing spectrometers is usually arranged on a Rowland circle of a small diameter, for example 100 mm. On the one hand, by virtue of the linear-focusing, the spectrometer allows the X-ray emission spectrum emitted by the sample dot to be focused with sufficient intensity into the detector, preferably a detector configured as a counting tube for X-ray radiation. The crystal with an interplanar spacing 2 d of 6 nm ensures that by means of a Bragg reflection, the $K_{\alpha 1}$ line of the X-ray emission spectrum of oxygen is diffracted with a high intensity in a wavelength-selective manner in the direction of the optical detector. This arrangement makes it possible in particular for even very small quantities of oxide particles to produce measurable $K_{\alpha 1}$ lines of the X-ray emission spectrum of oxygen.

BRIEF DESCRIPTION OF THE DRAWINGS

There are now provided a large number of possible embodiments of the strip according to the invention for the production of lithographic printing plate substrates as well as the method according to the invention for the characterization of a strip of aluminum or an aluminum alloy. In this respect, reference is made to the following description of embodiments in conjunction with the drawings, in which.

DESCRIPTION

Figure 1:
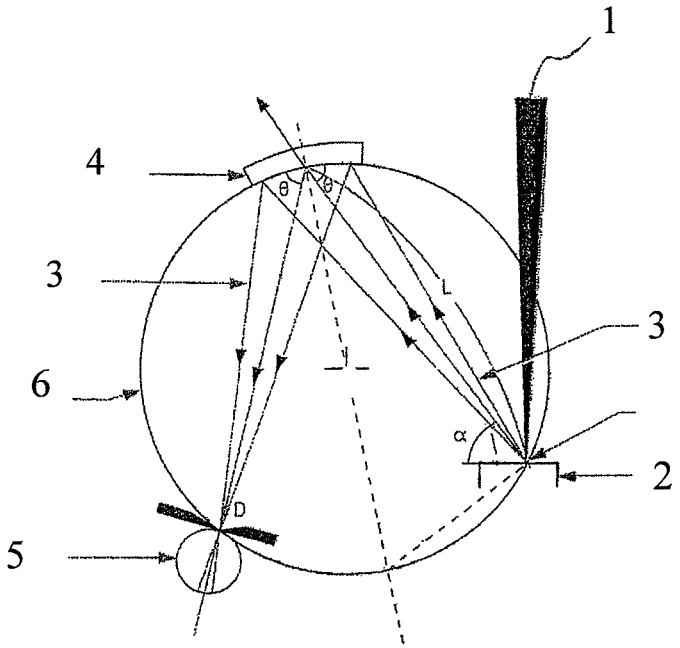
FIG. 1 is a schematic illustration of the linear-focusing spectrometer according to one embodiment of the characterization method according to the invention.

FIG. 1 shows the typical construction of the spectrometer of a microprobe analysis, in the present case a JEOL JXA 8200 type microprobe was used, in which an electron beam 1 is deflected onto a sample 2. The electrons are directed onto the sample 2 with an excitation voltage of 15 kV, a beam current of 50 nA and a beam cross section of 1 μm. The characteristic X-ray emission spectrum 3 is then produced in the sample 2, being generated by electronic transitions in the inner shells of the excited atoms. The wavelength of the emitted spectrum is therefore characteristic of each atom. The linear-focusing spectrometer shown in FIG. 1 has for wavelength analysis a bent crystal 4 which reflects in a focused way the X-ray radiation, emitted by the sample 2, in a wavelength selective manner into the slit of a detector 5. The take-off angle α of the characteristic X-ray radiation is 40°. The position of the crystal 4 on the Rowland circle 6 which, in this case, has a diameter of 100 mm, is adjusted such that only the $K_{\alpha 1}$ line of the characteristic X-ray spectrum of oxygen is diffracted into the detector by Bragg reflection. After the number of X-ray pulses has been counted in the detector over a measurement period of 0.6 s, the sample is transported further by the step size 16.75 μm and the next measurement point is measured.

Figure 2:
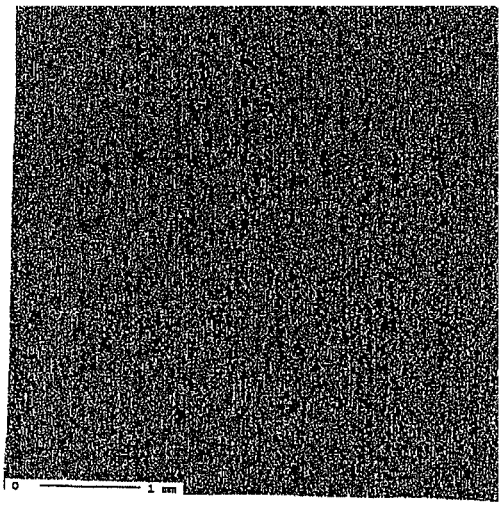
FIG. 2 shows the measurement result of a surface portion of a strip.

The spectrometer has a crystal of type LDE1H which is specifically adapted to the measurement of the $K_{\alpha 1}$ line of the X-ray emission spectrum of oxygen and is oriented to the maximum intensity of the oxygen spectrum and has an interplanar spacing 2 d of 6 nm. The penetration depth of the electrons into the sample 2, with an excitation voltage of 15 kV, is approximately 1 to 2 μm. On each sample, a square surface having an edge length of 5.025 mm was measured, wherein a step size of 16.75 μm was selected, such that overall 900 measurement points were measured in the square surface. FIG. 2 shows the measurement result of the two-dimensional microprobe analysis according to the mapping method on a sample, where on the one hand a square surface having an edge length of 16.75 μm and on the other hand the measured intensity ratio $I/I_{bulk(avg)}$ is associated with each measurement point. FIG. 2 shows the measured intensity values of the measured sample surface, which are converted into color values and which exhibit the microscopic streakiness in the direction of rolling, which is typical for the examined rolled strip surfaces. This streakiness is attributed to a distribution of rolled in surface particles in the rolling direction during the rolling procedure. Corresponding mappings were then evaluated in respect of their surface occupancy with specific intensity ratios $I/I_{bulk(avg)}$.

A total of eight strip samples was examined, each strip sample consisting of an AA1050 type aluminum alloy. The experiment setup for determining the size and occurrence of the oxide particles in the microcrystalline surface layer was selected as described above. In order to determine the influence of the microcrystalline surface layer in the measured intensity signal, additionally on a ninth sample consisting of an identical alloy, the microcrystalline surface layer was removed by stripping more than 2 μm in an etching step, the sample was stored for approximately 1 week to form a typical aluminum oxide layer, a two-dimensional microprobe analysis was also carried out and an average intensity signal $I_{bulk(avg)}$ was determined for the bulk material. 125 pulses were measured in 0.6 s as the averaged intensity signal under the aforementioned excitation and detection conditions. The intensity values, of the $K_{\alpha 1}$ line of the X-ray emission spectrum of oxygen measured on the samples were divided by the average intensity value of the bulk material and allocated in a corresponding mapping to a square measured surface having an edge length of 16.75 μm. The surface contents in the entire measured surface with dimensions of 5.025 mm×5.025 mm were then added up, which have an intensity ratio of $I/I_{bulk(avg)}$ of greater than 3 or respectively greater than 4. The surface portions measured in sample numbers 1 to 9 having an intensity ratio of $I/I_{bulk(avg)}$ of greater than 3 or respectively greater than 4 are shown in Table 1 together with the averaged intensity values $I_{avg}$ measured on the samples.

TABLE 1

| Sample No. | Sample | $I_{avg}$ | Surface portion in % where $I/I_{bulk(avg)} > 3$ | Surface portion in % where $I/I_{bulk(avg)} > 4$ | Evaluation |
|---|---|---|---|---|---|
| 1 | Comparison | 577 | 84 | 52 | −− |
| 2 | Comparison | 358 | 23.9 | 6.8 | −− |
| 3 | Comparison | 325 | 12.8 | 3.3 | − |
| 4 | Invention | 306 | 9.1 | 3.1 | o |
| 5 | Invention | 293 | 6.0 | 2.0 | o |
| 6 | Invention | 296 | 6.3 | 1.8 | + |
| 7 | Invention | 223 | 0.2 | 0 | ++ |
| 8 | Invention | 161 | 0.4 | 0.1 | ++ |
| 9 | Bulk | 125 | 0 | 0 | ++ |

Samples 1 to 9 or respectively the associated strips were then subjected to an electrochemical roughening procedure and their behaviour during electrochemical roughening was assessed.

It was found that samples 1, 2 and 3 produced defects during electrochemical roughening and did not allow an increase in the process velocity during said electrochemical roughening. Whilst samples 1 and 2 were assessed as being very poor (−−) with respect to electrochemical roughening, so that a homogeneous roughening could only be achieved with a very high introduction of charge carriers, the roughening ability improved with sample 3. However, sample 3 did not exhibit a satisfactory roughening ability. Prior to being measured, all the samples were subjected to a conventional degreasing procedure.

Fewer oxidic impurities on the surface and thus a satisfactory roughening characteristic was exhibited by sample 4, on which a surface portion having an intensity ratio of $I/I_{bulk(avg)}$ greater than 3 respectively greater than 4 of 9.1% respectively 3.1% was determined. The further samples 5 to 8 also exhibited satisfactory (o), good (+) or very good (++) roughening characteristics. Overall, there emerges a clear correlation between the surface portions of the regions measured in a microprobe mapping having a specific intensity ratio $I/I_{bulk(avg)}$ and the roughening characteristics of the microcrystalline surface of the strip.

The results of the experiments were evaluated to the effect that the intensity ratio $I/I_{bulk(avg)}$ corresponds to a measure for the size of the oxide particles in the microcrystalline surface layer and their surface portions correspond to the occurrence of oxide particles from a specific size. Where there is a very low surface occupancy with larger oxide particles, the roughening characteristics of the microcrystalline surface layer of the aluminum strip improve significantly.

The fact that the oxide particles constitute the major contribution to the measured distribution of the intensity ratio $I/I_{bulk(avg)}$, could be demonstrated by sample 5. Sample 5 corresponds to the formerly tested sample 2 which was also subjected to a surface etching process acting selectively on the rolled in particles. The surface of sample 5 was etched with a 10% $H_3PO_4$ solution at 80° C. for approximately 10 s. Since the phosphoric acid hardly attacks the aluminum matrix and merely selectively removes the oxide particles, the surface portion with an intensity ratio $I/I_{bulk(avg)}$ greater than 4 could be reduced from 23.9% to 6.0%. The surface portion in the microprobe measurement with an intensity ratio $I/I_{bulk(avg)}$ greater than 4 could be reduced from 6.8% to 2.0% using the phosphoric acid etchant. At the same time, it was thereby possible to improve the characteristics from poor to satisfactory with respect to an electrochemical roughening.

For comparison, Table 1 shows the measured values of the bulk sample 9. As a result of removing the microcrystalline surface layer, it is impossible to detect any larger oxidic inclusions on the surface of bulk sample 9. The measured values of the surface portions of $I/I_{bulk(avg)}$ were all at zero and the roughening ability was very good. The intensity of the characteristic X-ray emission spectrum of oxygen which was still measured is attributed to the formation of a natural aluminum oxide layer on the surface. In order to achieve a correction, as relevant to practice as possible, of the influence of the aluminum oxide layer on the measured result of the microprobe measurement, after removal of the microcrystalline surface layer, sample 9 was stored for approximately 1 week, such that a sufficiently thick aluminum oxide layer could form. In the measurement period of 0.6 s selected in the present embodiment, an average intensity signal $I_{bulk(avg)}$ of 125 pulses was measured over the sample surface.

The improved electrochemical roughening characteristics of samples 4 to 8 according to the invention are apparent particularly in a reduced charge carrier introduction for complete roughening during the electrochemical roughening of the surface of the samples. In this respect, a strip can be provided for lithographic printing plate substrates which allows higher process velocities in electrochemical roughening or in the production of lithographic printing plate substrates, respectively.

The invention claimed is:

1. Strip for the production of a substrate for lithographic printing plates consisting of aluminum alloy, the strip having at least to some extent a microcrystalline surface layer due to hot and/or cold roll passes which has been treated with a surface etching treatment partly removing oxide particles prior to electrochemical roughening, wherein, prior to an electrochemical roughening of the strip, in a two-dimensional microprobe analysis according to the mapping method of a surface region of the microcrystalline surface of the strip, the surface portion with an intensity ratio $\mathbf{1/1}_{bulk(avg)}$ of more than 3 in the spectral range of the $K_{\alpha 1}$ line of the X-ray emission spectrum of oxygen of the measured microcrystalline surface layer is less than 10%, wherein and during the two-dimensional microprobe analysis, an excitation voltage of 15 kV, a beam current of 50 nA and a beam cross section of 1 μm is used for a step size of 16.75 μm for the electron beam.

2. Strip according to claim 1, wherein the in the two-dimensional microprobe analysis according to the mapping method of a surface portion of the strip, the surface portion with an intensity ratio $\mathbf{1/1}_{bulk(avg)}$ of more than 4 in the spectral range of the $K_{\alpha}$line of the X-ray emission spectrum of oxygen of the measured microcrystalline surface layer is less than 3%.

3. Strip according to claim 1, wherein the strip consists of an aluminum alloy of type AA1050, AA1100 or AA3103.

4. Strip according to claim 1, wherein the aluminum strip consists of an aluminum alloy having the following proportions of alloy constituents in percent by weight:

| | |
|---|---|
| 0.05% ≤ | Si ≤ 0.1%, |
| 0.4% ≤ | Fe ≤ 1%, |
| | Cu ≤ 0.04%, |
| | Mn ≤ 0.3%, |
| 0.05% ≤ | Mg ≤ 0.3%, |
| | Ti ≤ 0.04%, |

remainder Al with unavoidable impurities
individually maximum 0.005%, in total maximum 0.15%.

* * * * *

UNITED STATES PATENT AND TRADEMARK OFFICE

CERTIFICATE OF CORRECTION

PATENT NO. : 9,206,494 B2
APPLICATION NO. : 12/374022
DATED : December 8, 2015
INVENTOR(S) : Kernig et al.

It is certified that error appears in the above-identified patent and that said Letters Patent is hereby corrected as shown below:

In the claims

Column 8, line 17, claim 2, --$K_{\alpha}$line-- should read --$K_{\alpha 1}$ line--

Column 8, line 34, claim 4, --individually maximum 0.005%, in total maximum 0.15%-- should read --individually, a maximum percent by weight of 0.005%, in total percent by weight, a maximum of 0.15%.--

Signed and Sealed this
Twenty-ninth Day of March, 2016

Michelle K. Lee

Michelle K. Lee
*Director of the United States Patent and Trademark Office*